US011131120B2

(12) United States Patent
Chang et al.

(10) Patent No.: US 11,131,120 B2
(45) Date of Patent: Sep. 28, 2021

(54) ELECTRIC LOCK AND CONTROL METHOD THEREOF

(71) Applicant: Taiwan Fu Hsing Industrial Co., Ltd., Kaohsiung (TW)

(72) Inventors: Pi-Shun Chang, Kaohsiung (TW); I-Chang Shih, Tainan (TW); Shih-Min Lu, Kaohsiung (TW)

(73) Assignee: Taiwan Fu Hsing Industrial Co., Ltd., Kaohsiung (TW)

( * ) Notice: Subject to any disclaimer, the term of this patent is extended or adjusted under 35 U.S.C. 154(b) by 168 days.

(21) Appl. No.: 16/566,985

(22) Filed: Sep. 11, 2019

(65) Prior Publication Data

US 2020/0370336 A1 Nov. 26, 2020

(30) Foreign Application Priority Data

May 20, 2019 (TW) ..... 108117366

(51) Int. Cl.
*E05B 47/00* (2006.01)
*G07C 9/00* (2020.01)
*G08C 17/02* (2006.01)

(52) U.S. Cl.
CPC ..... *E05B 47/0012* (2013.01); *G07C 9/00309* (2013.01); *G08C 17/02* (2013.01); *E05Y 2400/30* (2013.01); *G07C 2009/00769* (2013.01)

(58) Field of Classification Search
CPC ..... E05B 47/0012; G07C 9/00309; G07C 2009/00769; G07C 9/00944; G07C 2009/00579; G07C 2009/00634; G08C 17/02; E05Y 2400/30
See application file for complete search history.

(56) References Cited

U.S. PATENT DOCUMENTS

| | | | | |
|---|---|---|---|---|
| 8,354,914 | B2 * | 1/2013 | Buckingham | E05B 47/00 340/5.6 |
| 9,019,067 | B2 | 4/2015 | Bryla et al. | |
| 9,725,925 | B1 * | 8/2017 | Shen | E05B 47/0001 |
| 9,728,026 | B2 * | 8/2017 | Wang | G07C 9/00309 |
| 10,147,254 | B1 * | 12/2018 | Shen | G07C 9/00896 |
| 2005/0199019 | A1 * | 9/2005 | Marcelle | E05B 47/0012 70/38 A |

(Continued)

FOREIGN PATENT DOCUMENTS

| | | | |
|---|---|---|---|
| CN | 206071272 | U | 4/2017 |
| TW | M380366 | U | 5/2010 |

*Primary Examiner* — Brian E Miller
(74) *Attorney, Agent, or Firm* — Alan D. Kamrath; Karin L. Williams; Mayer & Williams PC

(57) ABSTRACT

An electric lock includes a motor, a power input port, a first control system and a second control system. The first control system includes an input unit configured to receive input data, an internal power source, and a first processing unit configured to use electricity of the internal power source to control the motor to rotate according to the input data. The second control system includes a wireless unit configured to receive a wireless signal, and a second processing unit different from the first processing unit and configured to use electricity of an external power source to control the motor to rotate when data transmitted in the wireless signal matches predetermined data and when the power input port is electrically connected to the external power source.

11 Claims, 5 Drawing Sheets

(56) References Cited

U.S. PATENT DOCUMENTS

| | | | | |
|---|---|---|---|---|
| 2014/0266586 | A1* | 9/2014 | Fisher | G06Q 50/16 340/5.61 |
| 2016/0060903 | A1* | 3/2016 | Russo | E05B 35/00 70/263 |
| 2016/0148453 | A1* | 5/2016 | Chang | G07C 9/00309 704/273 |
| 2018/0023321 | A1* | 1/2018 | Van Landingham, Jr. | E05B 47/0046 70/280 |
| 2018/0202192 | A1* | 7/2018 | Du | E05B 21/00 |
| 2019/0057566 | A1* | 2/2019 | Mlynarczyk | G06K 17/0029 |
| 2019/0244456 | A1* | 8/2019 | Steinmetz | G07C 9/00309 |
| 2020/0370336 | A1* | 11/2020 | Chang | G07C 9/00309 |

* cited by examiner

ELECTRIC LOCK AND CONTROL METHOD THEREOF

BACKGROUND OF THE INVENTION

1. Field of the Invention

The present invention relates to an electric lock/and more particularly to an electric lock having multiple control systems.

2. Description of the Prior Art

Generally, an electric lock has a control system configured to control a motor to rotate in order to perform locking or unlocking operation. When the motor is rotated in an unlocking direction, a clutch mechanism of the electric lock is engaged with a latch assembly of the electric lock, such that a user can turn a handle to open a door. When the motor is rotated in an unlocking direction, the clutch mechanism of the electric lock is disengaged from the latch assembly of the electric lock. Therefore, the door cannot be opened even if the user turns the handle. When the control system of the electric lock fails, the user can only use a key to open the door through a mechanical locking system of the electric lock. However, the mechanical locking system is bulky and is not conducive to design of the electric lock. Therefore, some electric locks do not comprise the mechanical locking system due to design considerations. As such, when a control system of a keyless electric lock of the prior art fails, the user must destroy the electric lock to open the door. Therefore, the keyless electric lock of the prior art has lower reliability.

SUMMARY OF THE INVENTION

The present invention provides an electric lock and a control method thereof.

The electric lock of the present invention comprises a motor, a power input port, a first control system and a second control system. The first control system comprises an input unit configured to receive input data, an internal power source, and a first processing unit configured to use electricity of the internal power source to control the motor to rotate according to the input data. The second control system comprises a wireless unit configured to receive a wireless signal, and a second processing unit different from the first processing unit and configured to use electricity of an external power source to control the motor to rotate when data transmitted in the wireless signal matches predetermined data and when the power input port is electrically connected to the external power source.

The control method of the electric lock of the present invention comprises providing an electric lock comprising a motor, a power input port, a first control system and a second control system, wherein the first control system comprises an input unit, an internal power source and a first processing unit, and the second control system comprises a wireless unit and a second processing unit different from the first processing unit; the input unit receiving input data; the first processing unit using electricity of the internal power source to control the motor to rotate according to the input data; the wireless unit receiving a wireless signal; and the second processing using electricity of an external power source to control the motor to rotate when data transmitted in the wireless signal matches predetermined data and when the power input port is electrically connected to the external power source.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
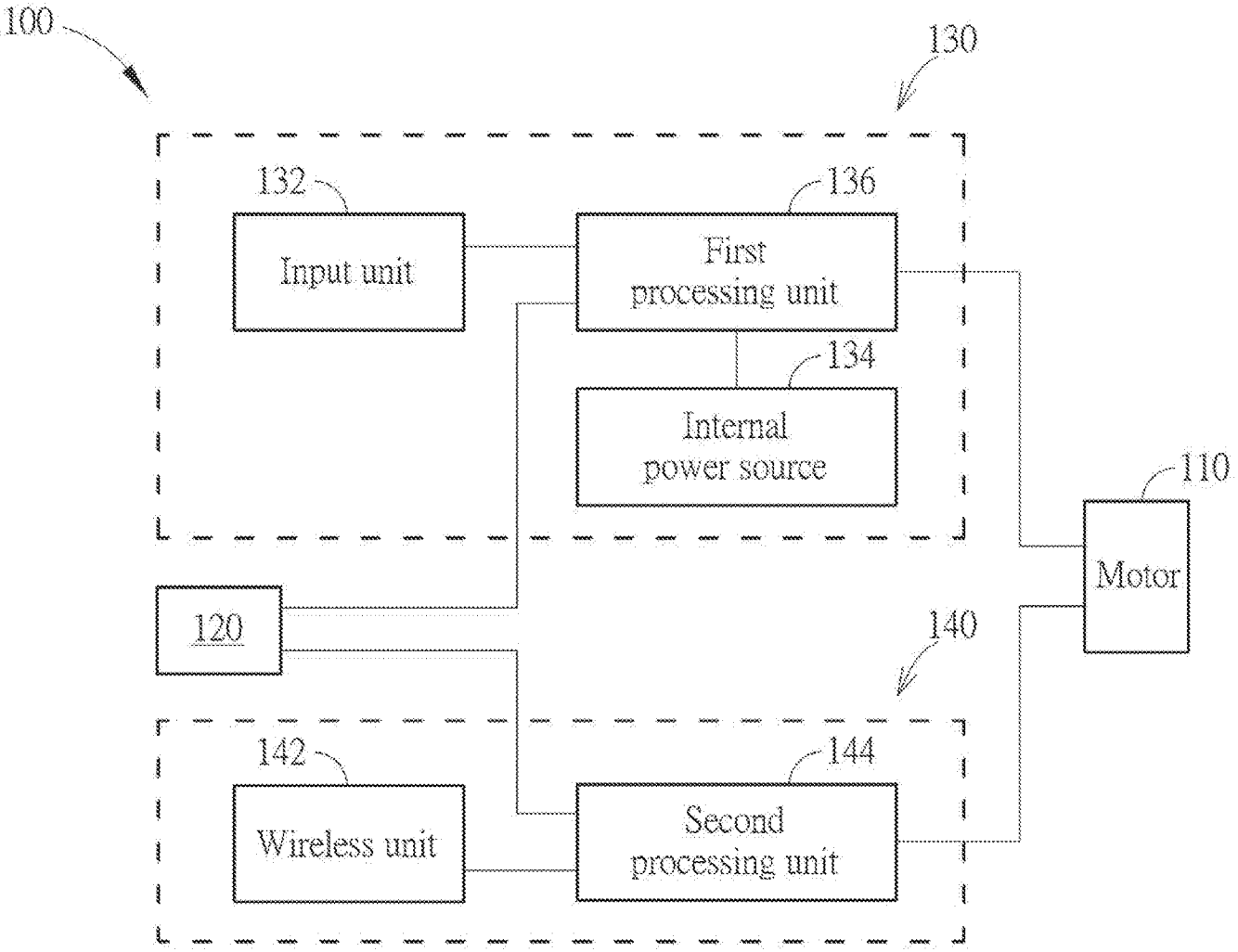
FIG. 1 is a functional block diagram of an electric lock of the present invention.

Please refer to FIG. 1. FIG. 1 is a functional block diagram of an electric lock of the present invention. As shown in FIG. 1, the electric lock 100 of the present invention comprises a motor 110, a power input port 120, a first control system 130 and a second control system 140. The first control system 130 comprises an input unit 132, an internal power source 134, and a first processing unit 136. The input unit 132 is configured to receive input data. For example, the input unit 132 comprises an input panel configured to receive button input or touch input, but the present invention is not limited thereto. The input unit 132 can also comprise other types of input devices, such as a wireless receiving device (configured to receive a wireless identification signal) or a biometric authentication device (configured to recognize a fingerprint, a face, a sound, an iris, etc.). The internal power source 134 is configured to provide electricity to the first processing unit 136 and the input unit 132, such that the first control system 130 can operate normally. The first processing unit 136 is configured to perform operation according to the input data received by the input unit 132. The second control system 140 comprises a wireless unit 142 and a second processing unit 144. The wireless unit 142 is configured to receive a wireless signal. The second processing unit 144 is different from the first processing unit 136. In other words, the second processing unit 144 and the first processing unit 136 are two independent processing units.

Figure 2:
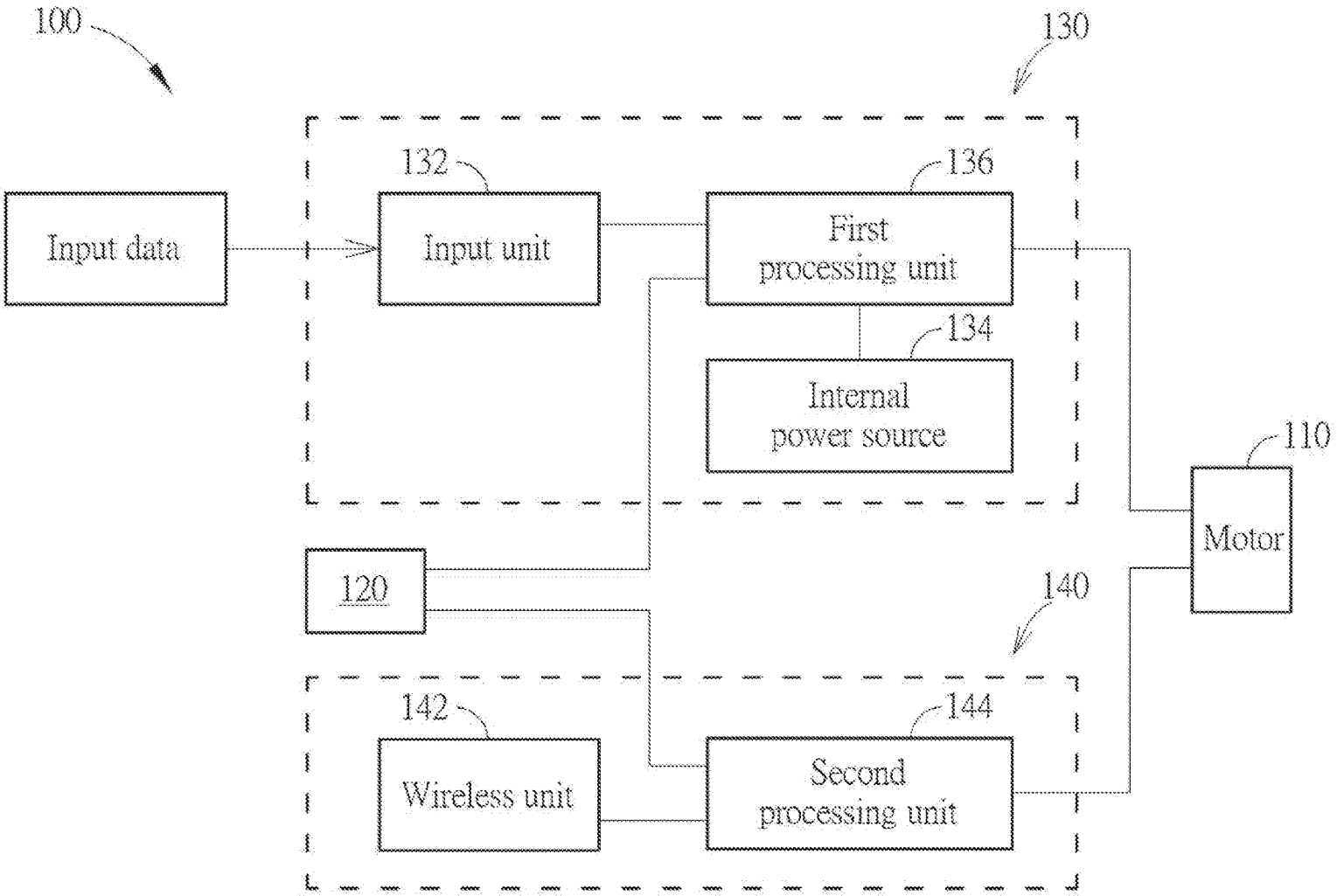
FIG. 2 is a diagram showing operation of a first control system of the electric lock of the present invention.

Please refer to FIG. 2. FIG. 2 is a diagram showing operation of the first control system of the electric lock of the present invention. As shown in FIG. 2, the input unit 132 of the first control system 130 is configured to receive the input data. The input data can be a password, a touch gesture, a wireless identification signal or biometric data (such as fingerprint data, facial data, sound data, iris data, etc.), but the present invention is not limited thereto. When the input data received by the input unit 132 matches identification data stored in the first processing unit 136, the first processing unit 136 is configured to use the electricity provided by the internal power source 134 to control the motor 110 to rotate in an unlocking direction, so as to drive the electric lock 100 to perform an unlocking operation (such as driving a clutch mechanism of the electric lock to engage with a latch assembly of the electric lock). On the other hand, when the input data received by the input unit 132 is a locking instruction, the first processing unit 136 is configured to use the electricity provided by the internal power source 134 to control the motor 110 to rotate in a locking direction, so as to drive the electric lock 100 to perform a locking operation (such as driving the clutch mechanism of the electric lock to disengage from the latch assembly of the electric lock).

Moreover, when the internal power source 134 runs out of electricity, a user can electrically connect an external power source (not shown in FIG. 2) to the power input port 120, such that the first control system 130 can operate normally. In this way, the first processing unit 136 can use the electricity provided by the external power source to control the motor 110 to rotate, so as to drive the electric lock 100 to perform locking operation or unlocking operation.

Figure 3:
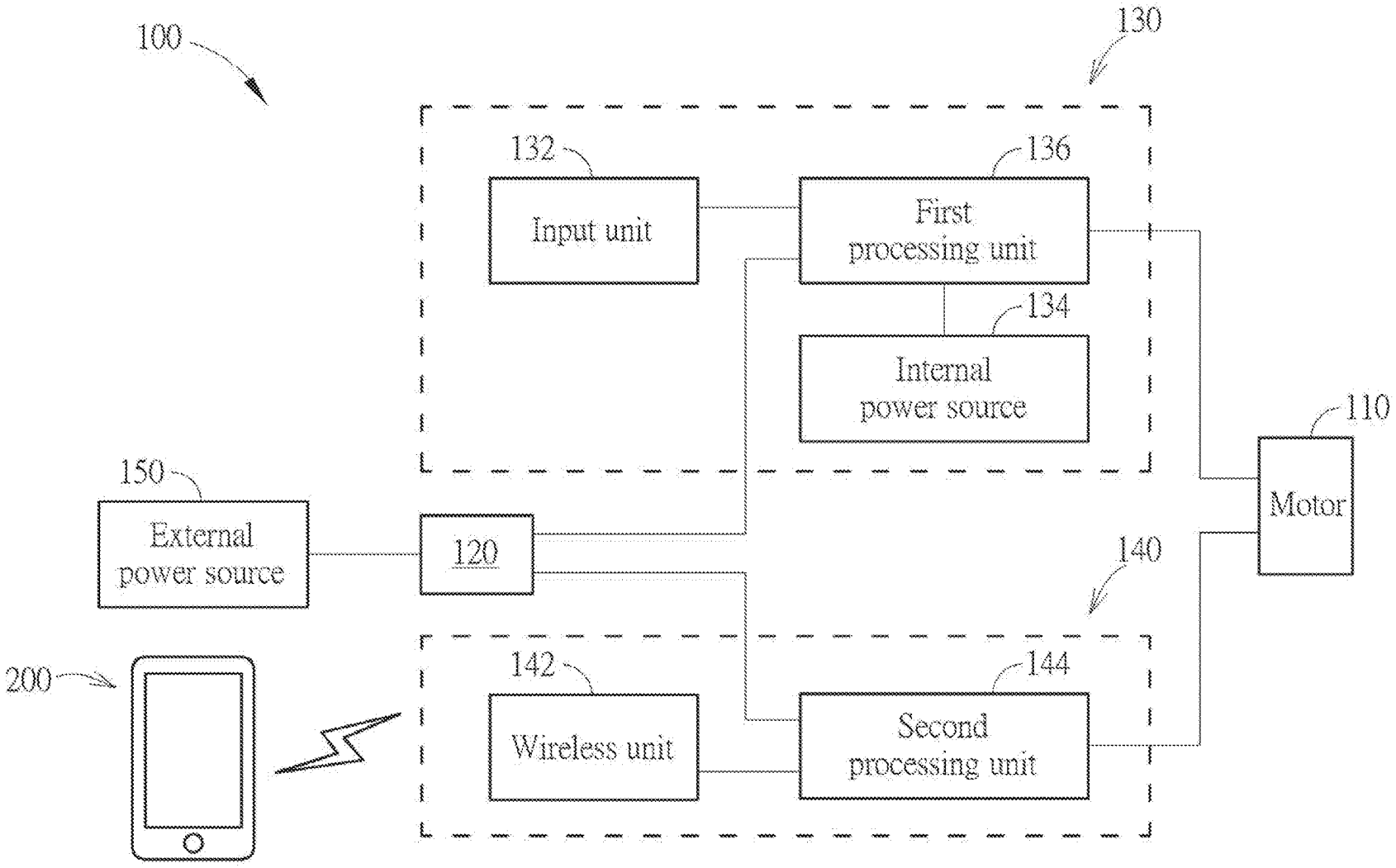
FIG. 3 is a diagram showing operation of a second control system of the electric lock of the present invention.
Figure 4:
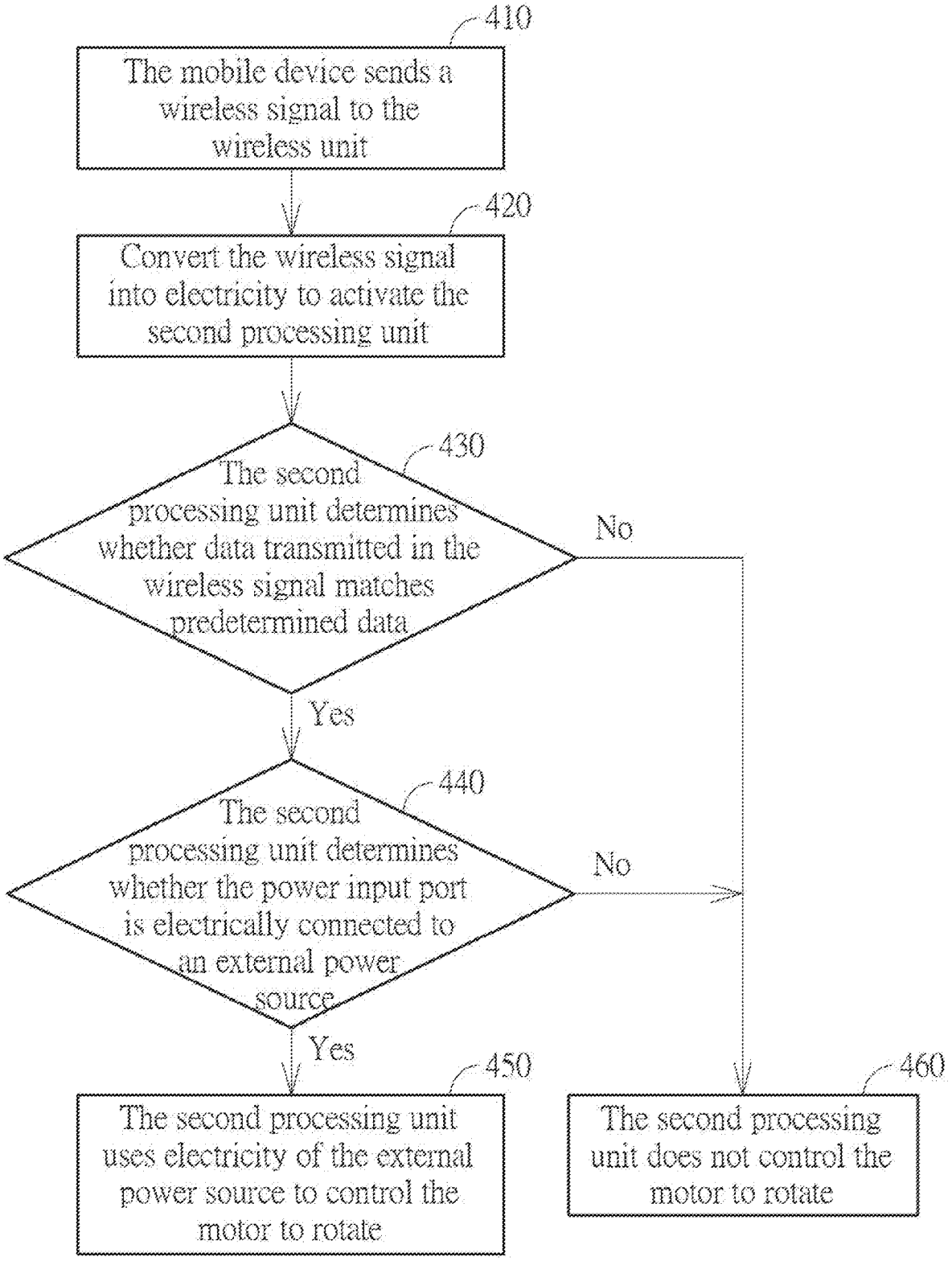
FIG. 4 is a flowchart showing the operation of the second control system of the electric lock of the present invention.

Please refer to FIG. 3 and FIG. 4. FIG. 3 is a diagram showing operation of the second control system of the electric lock of the present invention. FIG. 4 is a flowchart showing the operation of the second control system of the electric lock of the present invention. The wireless unit 142 of the second control system 140 is configured to receive a wireless signal. For example, the wireless unit 142 is configured to receive a wireless signal generated by short-range wireless communication technology, such as a near-field communication (NFC) signal, a radio frequency identification (RFID) signal, a Bluetooth signal or an infrared signal, etc. When the first control system 130 fails, the user can place a mobile device 200 to be close to the electric lock 100, and then operate the mobile device 200 to send a wireless signal to the wireless unit 142 (Step 410). When the wireless unit 142 receives the wireless signal sent from the mobile device 200, the wireless unit 142 can convert the wireless signal into electricity, and provide the electricity to the second processing unit 144 to further activate the second processing unit 144 (Step 420). After being activated, the second processing unit 144 determines whether data transmitted in the wireless signal matches predetermined data stored in the second processing unit 144 (Step 430). When the second processing unit 144 determines that the data transmitted in the wireless signal matches the predetermined data stored in the second processing unit 144 (that is, the mobile device 200 is an authenticated device), the second processing unit 144 further determines whether the power input port 120 is electrically, connected to an external power source 150 (Step 440). Thereafter, when the second processing unit 144 determines that the power input port 120 is electrically connected to the external power source 150, the second processing unit 144 is configured to use electricity of the external power source 150 to control the motor 110 to rotate (Step 450). In addition, when a determination result in Step 430 or Step 440 is negative, the second processing unit 144 does not control the motor 110 to rotate (Step 460).

In one embodiment of the present invention the second control system 140 works as a backup system when the first control system 130 fails. Therefore, the second processing unit 144 is configured to use the electricity of the external power source 150 to control the motor 110 to rotate only in the unlocking direction in Step 450. In other words, the second control system 140 only needs to drive the electric lock 100 to perform the unlocking operation, but the present invention is not limited thereto. Moreover, after the wireless unit 142 converts the wireless signal into electricity, the second processing unit 144 is configured to use the electricity converted from the wireless signal to perform operation. In other words, the electricity required by the second processing unit 144 for operation is converted from the wireless signal, but the present invention is not limited thereto. The electricity required by the second processing unit 144 for operation can also be provided by the external power source 150. In addition, the predetermined data stored in the second processing unit 144 can be unique identification data of the mobile device 200, such as an international mobile equipment identity (IME) or a media access control address (MAC address), but the invention is not limited thereto. On the other hand, the external power source 150 can be a 9V battery or a 5V USB power source, but the invention is not limited thereto. Furthermore, each of the first processing unit 136 and the second processing unit 144 can comprise a microprocessor and a driver, but the invention is not limited thereto. The microprocessor is configured to control the driver to drive the motor 110 to rotate according to a control signal.

According to the aforementioned arrangement, when the first control system 130 of the electric lock 100 fails, the second control system 140 of the electric lock 100 can work as a backup system to unlock the electric lock 100. The user can place the authenticated mobile device 200 to be close to the electric lock 100 and electrically connect the external power source 150 to the power input port 120 to further activate and request the second control system 140 to perform the unlocking operation. Moreover, since the second control system 140 is independent of the first control system 130, the operation of the second control system 140 is not affected by the failure of the first control system 130.

Figure 5:
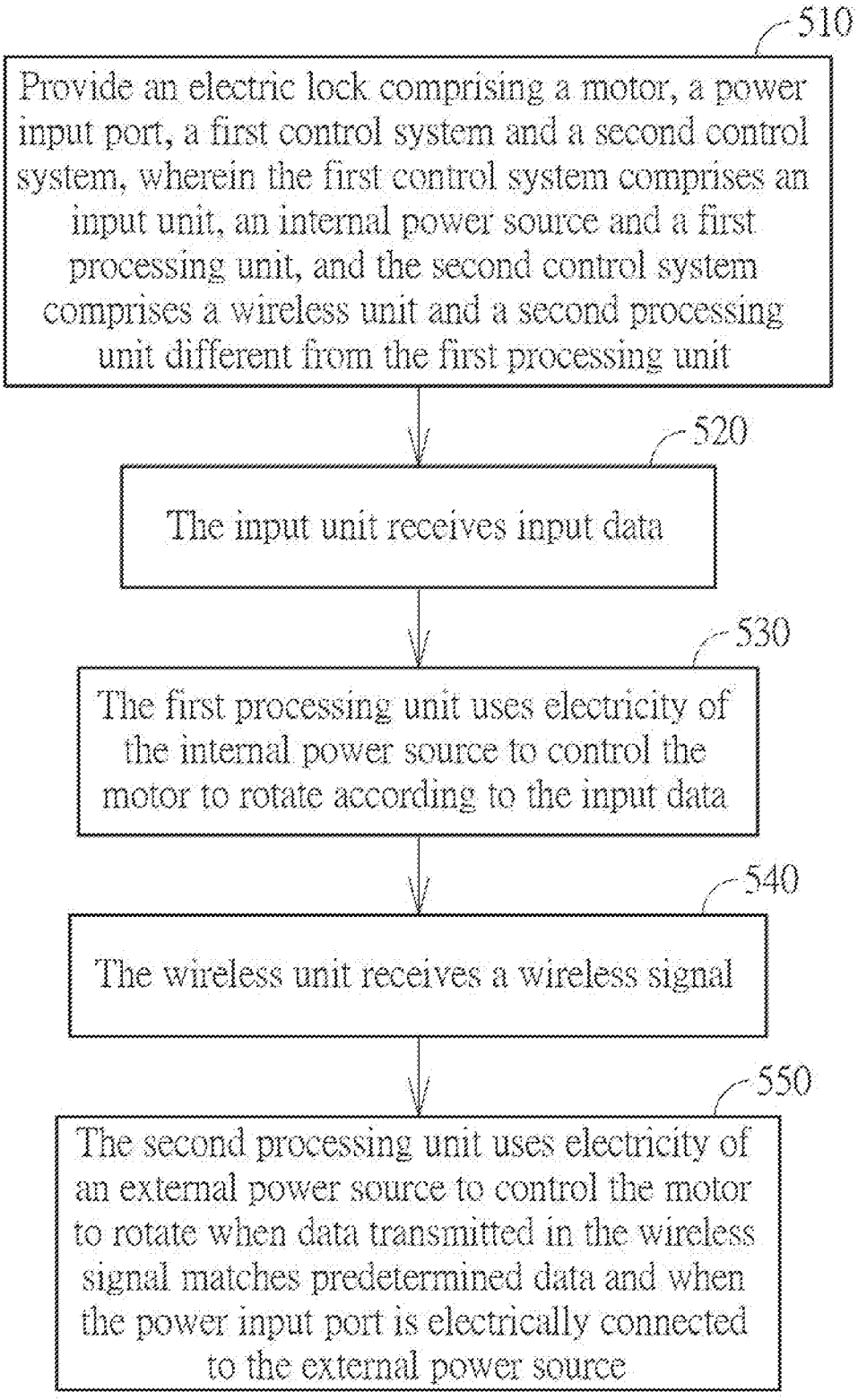
FIG. 5 is a flowchart showing a control method of the electric lock of the present invention.

Please refer to FIG. 5. FIG. 5 is a flowchart showing a control method of the electric lock of the present invention. The flowchart of the control method of the electric lock of the present invention comprises the following steps:

Step 510: Provide an electric lock comprising a motor, a power input port, a first control system and a second control system, wherein the first control system comprises an input unit, an internal power source and a first processing unit, and the second control system comprises a wireless unit and a second processing unit different from the first processing unit;

Step 520: The input unit receives input data;

Step 530: The first processing unit uses electricity of the internal power source to control the motor to rotate according to the input data;

Step 540: The wireless unit receives a wireless signal; and

Step 550: The second processing unit uses electricity of an external power source to control the motor to rotate when data transmitted in the wireless signal matches predetermined data and when the power input port is electrically connected to the external power source.

In addition, in the control method of the electric lock of the present invention, the aforementioned steps need not be in the exact order shown. That is, the order of the steps can be changed and other steps can be inserted in between.

In contrast to the prior art, the electric lock of the present invention has multiple control systems. When the first control system of the electric lock fails, the user can use the authenticated mobile device and the external power source as a key to further activate the second control system and request the second control system to perform the unlocking operation. In other words, the second control system of the electric lock of the present invention works as a backup system to replace a mechanical locking system. Moreover, since the second control system is independent of the first control system, the operation of the second control system is not affected by the failure of the first control system. Therefore, as a keyless electric lock, the electric lock of the present invention can have higher reliability.

Those skilled in the art will readily observe that numerous modifications and alterations of the device and method, may be made while retaining the teachings of the invention. Accordingly, the above disclosure should be construed as limited only by the metes and bounds of the appended claims.

What is claimed is:

1. An electric lock, comprising:

a motor;

a power input port;

a first control system, comprising:

an input unit configured to receive input data;

an internal power source; and a first processing unit configured to use electricity of the internal power source to control the motor to rotate according to the input data; and a second control system independent of the first control system, comprising:

a wireless unit configured to receive a wireless signal; and a second processing unit independent of and different from the first processing unit and configured to use electricity of an external power source to control the motor to rotate when data transmitted in the wireless signal matches predetermined data and when the power input port is electrically connected to the external power source;

wherein the internal power source is configured to provide electricity to the first processing unit through a first path, the external power source is configured to provide electricity to the second processing unit via the power input port through a second path, and the first path is independent of and different from the second path.

2. The electric lock of claim 1, wherein the second processing unit is activated by electricity converted from the wireless signal.

3. The electric lock of claim 1, wherein electricity required by the second processing unit for operation is converted from the wireless signal.

4. The electric lock of claim 1, wherein the second processing unit is configured to control the motor to rotate only in an unlocking direction.

5. The electric lock of claim 1, wherein the wireless signal is a near-field communication (NFC) signal, a radio frequency identification (RFID) signal, a Bluetooth signal or an infrared signal.

6. The electric lock of claim 1, wherein the first processing unit is further configured to use the electricity of the external power source to control the motor to rotate according to the input data.

7. A control method of an electric lock, comprising:

providing an electric lock comprising a motor, a power input port, a first control system and a second control system independent of the first control system, wherein the first control system comprises an input unit, an internal power source and a first processing unit, and the second control system comprises a wireless unit and a second processing unit independent of and different from the first processing unit;

the input unit receiving input data;

the first processing unit using electricity of the internal power source to control the motor to rotate according to the input data;

the wireless unit receiving a wireless signal; and the second processing unit using electricity of an external power source to control the motor to rotate when data transmitted in the wireless signal matches predetermined data and when the power input port is electrically connected to the external power source;

wherein the internal power source is configured to provide electricity to the first processing unit through a first path, the external power source is configured to provide electricity to the second processing unit via the power input port through a second path, and the first path is independent of and different from the second path.

8. The control method of the electric lock of claim 7, further comprising:

the wireless unit converting the wireless signal into electricity; and using the electricity converted from the wireless signal to activate the second processing unit.

9. The control method of the electric lock of claim 7, wherein the second processing unit is configured to control the motor to rotate only in an unlocking direction.

10. The control method of the electric lock of claim 7, wherein the wireless signal is a near-field communication (NFC) signal, a radio frequency identification (RFID) signal, a Bluetooth signal or an infrared signal.

11. The control method of the electric lock of claim 7, further comprising the first processing unit using the electricity of the external power source to control the motor to rotate according to the input data.

* * * * *